US006227795B1

(12) United States Patent
Schmoll, III

(10) Patent No.: US 6,227,795 B1
(45) Date of Patent: May 8, 2001

(54) CONTOURED PROPULSION BLADE AND A DEVICE INCORPORATING SAME

(76) Inventor: George F. Schmoll, III, 34303 Birch La., Gurnee, IL (US) 60131

( * ) Notice: Subject to any disclaimer, the term of this patent is extended or adjusted under 35 U.S.C. 154(b) by 0 days.

(21) Appl. No.: 09/238,524

(22) Filed: Jan. 27, 1999

(51) Int. Cl.[7] ..... F01D 1/36
(52) U.S. Cl. ..... 415/90; 415/198.1; 416/198 R
(58) Field of Search ..... 415/90, 53.1, 206, 415/76, 198.1; 416/198 R

(56) References Cited

U.S. PATENT DOCUMENTS 1,047,898 12/1912 Scott .
1,383,937 * 7/1921 Guthrie ..... 415/90
1,489,930 * 4/1924 Clary ..... 415/90
4,255,081 * 3/1981 Oklejas et al. ..... 415/90
4,403,911 * 9/1983 Possell ..... 415/90
4,768,920 9/1988 Gurth .
5,192,182 3/1993 Possell ..... 415/90

* cited by examiner

*Primary Examiner*—F. Daniel Lopez
*Assistant Examiner*—Richard Woo
(74) *Attorney, Agent, or Firm*—Patents +TMS

(57) ABSTRACT

A blade and a series of blades are provided for implementation into a device, such as, for example, a turbine, a fan, a pump or the like. The blades are substantially flat and include at least one rib or irregularity peripherally formed in the blade equidistantly from the center of the blade. The blade may include one or more ribs and the ribs are formed equidistantly on each blade such that a plurality of blades may be stacked closely without interference from the ribs formed in adjacent blades.

20 Claims, 2 Drawing Sheets

CONTOURED PROPULSION BLADE AND A DEVICE INCORPORATING SAME

BACKGROUND OF THE INVENTION

The present invention generally relates to propulsion blades for a device, such as a disk pump. More specifically, the present invention relates to a propulsion blade having at least one irregularity or contour in a surface of the blade that is identically repeated in a series of blades for use in device, such as a pump, an engine or the like.

It is, of course, generally known to provide pumps or engines that are designed to use and implement a plurality of blades stacked one atop another with minimal spacing therebetween. The blades, upon high speed rotation, provide an engine or motor with the highest possible power output using a minimum amount of energy. The power is derived from the force imparted through rotation of the blades by, for example, impact, adhesion, viscosity and static expansion derived from a fluid such as gas, steam, water, air, or the like when forced upon the rotating blades.

Known blades used for this purpose are typically planar and are stacked as a series of parallel blades. It is known, for example, in U.S. Pat. No. 1,047,898 to provide an engine with rotor blades or plates having circumferential teeth adapted to receive the direct impact of a fluid as well as the faces of the disk receiving the impact of the fluid thereby resulting in a higher starting torque and increased power at all speeds. In operation, fluid is introduced through an inlet port and directed against serrations about a circumference of the disk thereby imparting a propulsive force thereto. The impact of the fluid against the face of the disk takes a spiral course. The length of the spiral course corresponds to the speed of rotation of the plates. As a result of the direct impact upon the disk together with the adhesion of the fluid to the disk, a high starting torque results in a corresponding increase.

A need, however, exists for an improved disk and/or parallel spaced disks used, for example, in a pump to further improve the efficiency and output power of the device in which the blades are implemented.

SUMMARY OF THE INVENTION

The present invention generally relates to a disk or a plurality of disks as well as a pump, motor, or other device that uses those disks to increase efficiency and power output of the device.

To this end, in an embodiment of the present invention, a blade is provided. The blade is a circular disk that has a central opening wherein the disk is constructed from a stamped material forming a single planar layer with an equal radius defining an outer periphery of the disk. A first rib is integrally formed in the material creating a non-planar section of the disk wherein the first rib is formed circumferentially and equidistantly around the disk at a point intermediate the central opening and the outer periphery of the disk.

In an embodiment, at least one additional rib is integrally formed in the material creating a non-planar section of the disk wherein the at least one additional rib is formed circumferentially and equidistantly around the disk at a point intermediate the central opening and the outer periphery of the disk and at a point distinct from the first rib.

In an embodiment, the first rib and the at least one additional rib are substantially identically shaped.

In an embodiment, the material is a metal.

In an embodiment, the central opening is circular.

In another embodiment of the present invention, a rotor is provide. The rotor has a plurality of blades wherein each of the plurality of blades has a central opening. Each of the plurality of blades is positioned in a parallel relationship with their central openings aligned. Each of the plurality of blades has an equal radius defining an outer periphery of each of the plurality of blades. An integrally formed rib is provided in at least one of the plurality of blades creating a non-planar section of the at least one of the plurality of blades wherein the rib is formed circumferentially and equidistantly around the disk at a point intermediate the central opening and the outer periphery of the disk.

In an embodiment, an integrally formed rib is provided in each of the plurality of blades.

In an embodiment, each of the integrally formed ribs are stamped equidistantly and circumferentially from the central opening of each of the plurality of blades.

In an embodiment, at least one additional rib is integrally formed in the at least one of the plurality of blades. At least one additional rib is integrally formed in each one of the plurality of blades.

In an embodiment, each of the at least one additional ribs are stamped equidistantly and circumferentially from the central opening of each of the plurality of blades.

In an embodiment, the central opening of each of the plurality of blades is circular.

In an embodiment, each of the plurality of blades is metallic.

In an embodiment, each of the ribs are substantially identically shaped.

In another embodiment of the present invention, a device is provided. The device has a housing that has exterior walls defining an interior wherein the interior is capable of receiving a fluid therein. A plurality of blades is provided within the interior of the housing, each of the plurality of blades having a central opening wherein the plurality of blades have an equal radius defining an outer periphery.

A shaft is provided on which each of the plurality of blades is rotatably attached. A first rib is formed in each one of the plurality of blades wherein the rib is equidistantly and circumferentially stamped in each of the plurality of blades.

In an embodiment, an additional rib is provided in each one of the plurality of blades wherein the additional rib is equidistantly and circumferentially stamped in each of the plurality of blades at a position intermediate the central opening and the outer periphery and distinct from a position of the first rib.

In an embodiment, the plurality of blades are metallic.

In an embodiment, the first rib and the additional rib are substantially identically shaped.

In an embodiment, the central opening is circular.

It is, therefore, an advantage of the present invention to provide a disk as well as a device implementing a plurality of the disks which incorporates disks which may be manufactured by stamping the disks.

Another advantage of the present invention is to provide a disk and a device incorporating a plurality of those disks that allows for thinner layers of metal to be implemented to achieve the same efficiency.

Yet another advantage of the present invention is to provide a disk and device implementing a plurality of those disks that provides greater efficiencies and pumping capabilities.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention generally relates to a disk for use in a device, such as a pump. Preferably, a plurality of those disks are stacked one atop another and incorporated in the interior of a housing as generally illustrated in FIG. 1.

Figure 1:
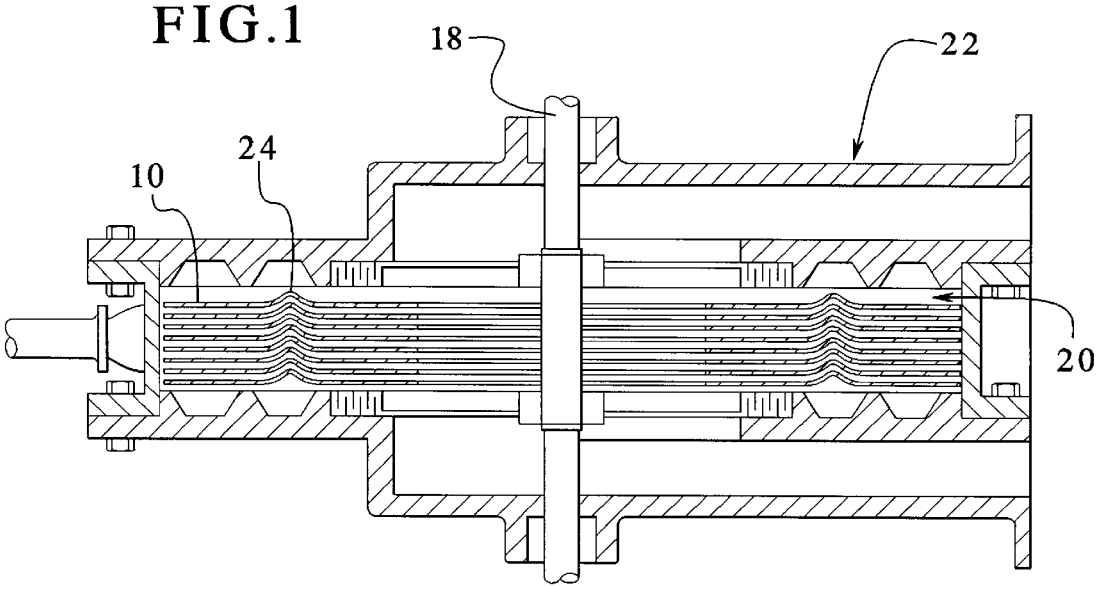
FIG. 1 illustrates a cross-sectional view of an embodiment of a pump incorporating a plurality of disks in an embodiment of the present invention.
Figure 2:
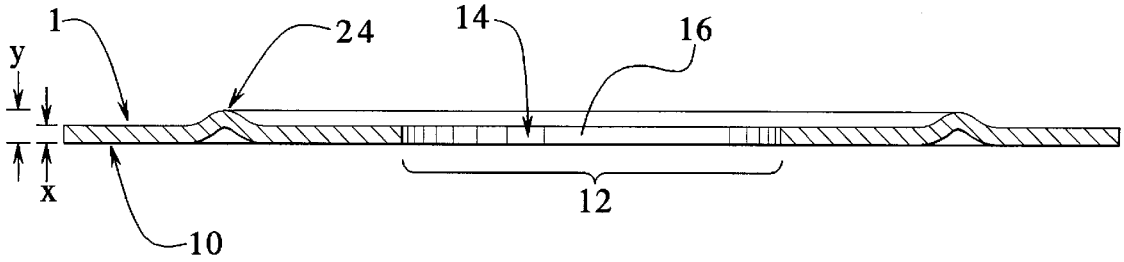
FIG. 2 illustrates a cross-sectional view of an embodiment of a disk of the present invention.
Figure 3:
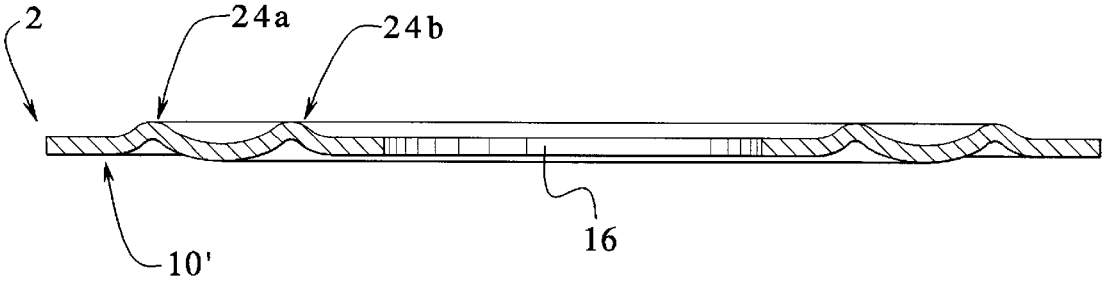
FIG. 3 illustrates a cross-sectional view of another embodiment of a disk of the present invention.
Figure 4:
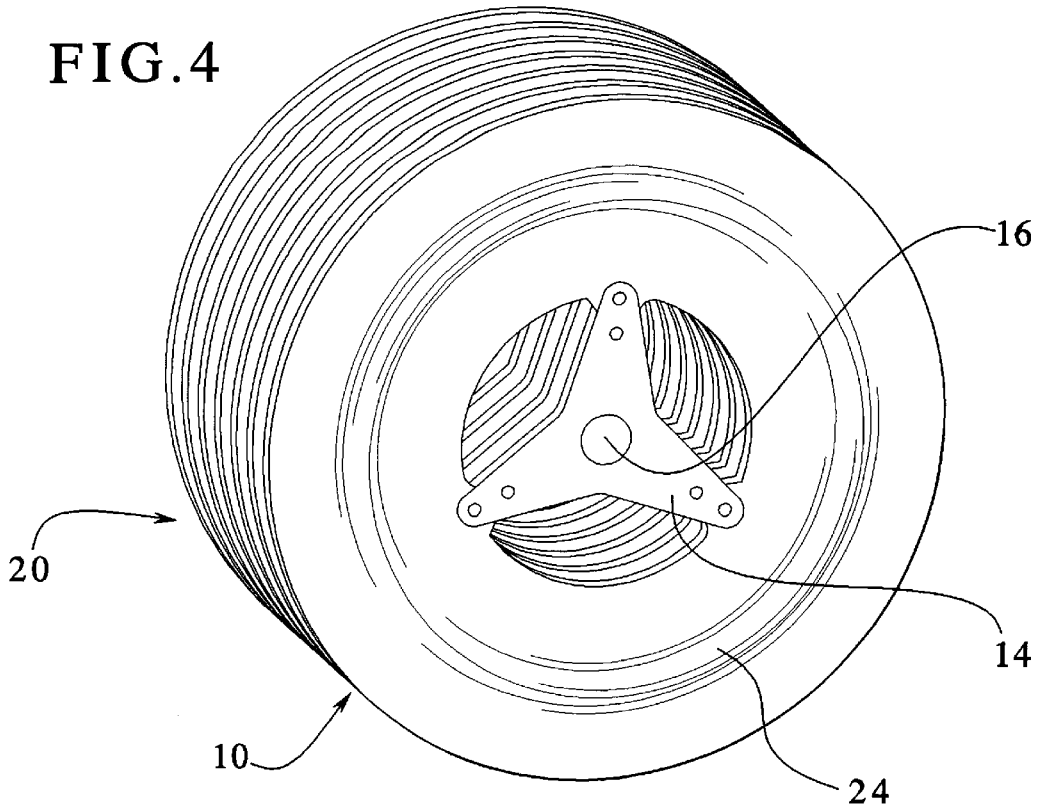
FIG. 4 illustrates a perspective view of an embodiment of a plurality of disks in an embodiment of the present invention.
Figure 5:
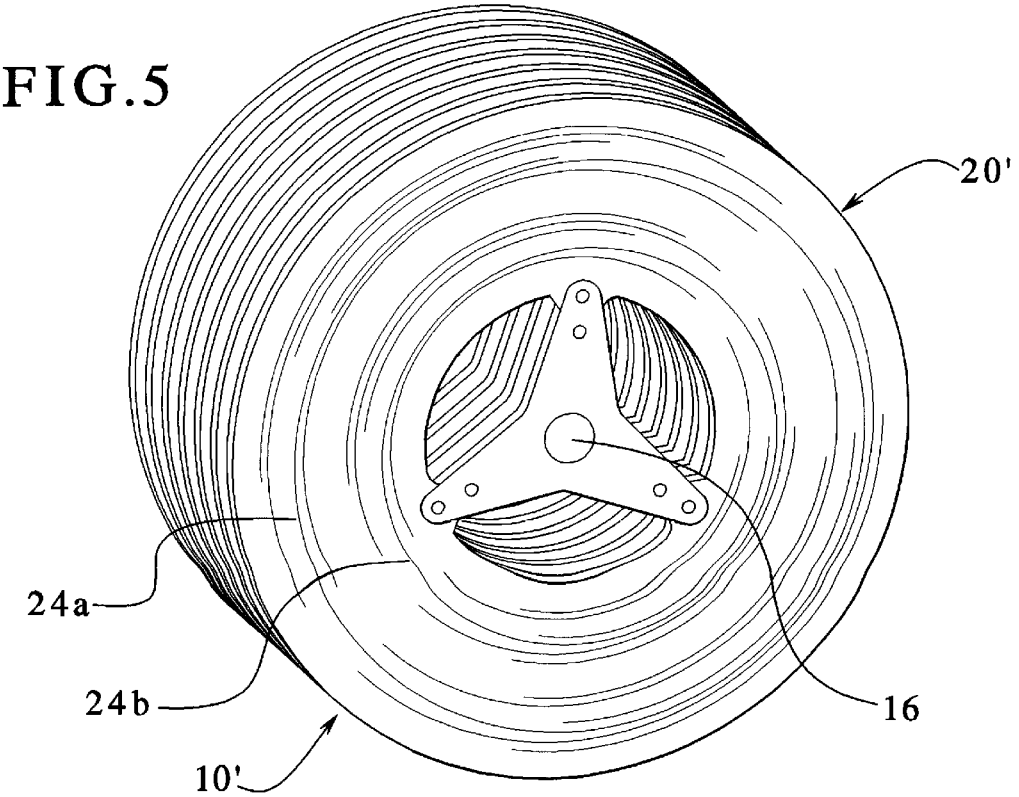
FIG. 5 illustrates a perspective view of another embodiment of a plurality of disks of the present invention.

Referring now to the drawings wherein like numerals refer to like parts, FIG. 2 generally illustrates an embodiment of a disk 1, and FIG. 3 generally illustrates an embodiment of another disk 2. The embodiment illustrated in FIG. 1 generally includes a substantially flat metal plate 10. The plate 10 is in the form of a circular disk having a central opening generally designated at 12. The opening 12 may incorporate, for example, a spoked adapter 14 therein such as more clearly illustrated in FIGS. 4 and 5 wherein the spoked adapter contains an aperture 16 through which a rotor 20 is fed for attachment and rotation of the plates 10 or plurality of plates by a shaft 18 that, in turn, is connected to a drive shaft for high speed rotation of the plates.

The plates 10 of the rotor 20 are connected to one another in a spaced relation on the shaft 18 and rigidly secured to the shaft 18 for driving or rotating the plates 10 with, for example, a motor (not shown). The rotor 20 is mounted within a casing 22. The structure of the casing and the use thereof is well-known in the art and is generally shown and described in U.S. Pat. No. 1,061,206 to Tesla, the disclosure of which is incorporated herein by reference in its entirety.

While the plates 10 of the present invention are shown in FIG. 1 in use within a turbine, other types of systems may incorporate the plates such as fluid propulsion pumps generally known and described in, for example, U.S. Pat. No. 1,061,142 or, for example, in a fan such as known and described in U.S. Pat. No. 5,240,371. The disclosures of U.S. Pat. Nos. 1,061,142 and 5,240,371 are incorporated herein by reference in their entireties. The present invention, however, is specifically directed to the construction of the plates and their use within any known device, such as an engine, fan, pump or the like, which may be implemented by those skilled in the art.

Referring again to FIG. 2, the plate 10 includes a rib 24 peripherally formed in the plate 10. As a result, a ridge or irregularity is formed by the rib 24 in the plate 10. The plate 10 may be manufactured by stamping the same. As a result of the rib 24 created in the plate 10, the plate may be made thinner shown by the dimension x in FIG. 2 than previously known plates or disks. Using the plate 10 creates greater efficiencies than uniformly planar disks known in the prior art. In addition, the plates 10 produce greater performance characteristics and are simple to manufacture.

In addition to the foregoing, the plates 10 in the rotor 20 may be spaced closely together even with the additional height y created by the rib 24 in the plate 10. The plates 10 are manufactured such that the rib 24 is at the same peripheral distance from the aperture 16 such that, when stacking the plates 10 as generally illustrated in FIGS. 1 and 2, the height of the rib 24 does not affect the relationship with adjacent plates. Rather, the ribs 24 are aligned in parallel with the axis between adjacent plates.

FIG. 3 illustrates a variation of the plate 10 shown in FIG. 2. The plate 10' includes two ribs 24*a*,24*b* equally and peripherally spaced about the opening 16 formed in the plate 10'. Each of the ribs 24*a*,24*b* is peripherally spaced about the plate 10 and the precise spacing between the ribs 24*a*, 24*b* is not critical to the present invention. Moreover, the number of ribs is not necessarily limited to the two ribs 24*a*,24*b* illustrated in FIG. 3, but a plurality of ribs may be provided greater than the two ribs 24*a*,24*b* generally shown and illustrated with respect to FIGS. 3 and 5. Like the rotor 20 illustrated in FIGS. 1 and 4, the rotor 20' is created by stacking a plurality of the plates 10' shown and illustrated in FIG. 3. A rotor 20' with the plurality of disks 10' may be closely spaced as the ridges 24*a*,24*b* are aligned vertically with the aperture 16.

Preferably, the blades 10,10' are stamped from a metal, such as aluminum or steel, or other metal alloys. However, of course, other materials may be implemented by those skilled in the art depending on the application in which the blades are used or as a series of blades creating a rotor.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A blade comprising:

a smooth circular disk having a central opening wherein the disk is constructed from a stamped material forming a single planar layer with an equal radius defining an outer periphery of the disk; and a first rib integrally formed in the material creating a single non-planar section in the single planar layer of the disk wherein the first rib is formed circumferentially and equidistantly around the disk at a point intermediate the central opening and the outer periphery of the disk.

2. The blade of claim 1 further comprising:

at least one additional rib integrally formed in the material creating a non-planar section of the disk wherein the at least one additional rib is formed circumferentially and equidistantly around the disk at a point intermediate the central opening and the outer periphery of the disk and at a point distinct from the first rib.

3. The blade of claim 2 wherein the first rib and the at least one additional rib are substantially identically shaped.

4. The blade of claim 1 wherein the material is a metal.

5. The blade of claim 1 wherein the central opening is circular.

6. A rotor comprising:

a plurality of blades wherein each of the plurality of blades is smooth and planar and has a central opening and further wherein each of the plurality of blades are positioned in a parallel relationship with their central openings aligned and still further wherein each of the plurality of blades has an equal radius defining an outer periphery of each of the plurality of blades; and an integrally formed rib in at least one of the plurality of blades creating a single, non-planar section in the planar layer of at least one of the plurality of blades wherein the rib is formed circumferentially and equidistantly around the disk at a point intermediate the central opening and the outer periphery of the disk.

7. The rotor of claim 6 further comprising:

an integrally formed rib in each of the plurality of blades.

8. The rotor of claim 7 wherein each of the integrally formed ribs are stamped equidistantly and circumferentially from the central opening of each of the plurality of blades.

9. The rotor of claim 6 further comprising:

at least one additional rib integrally formed in the at least one of the plurality of blades.

10. The rotor of claim 9 wherein each of the ribs are substantially identically shaped.

11. The rotor of claim 6 further comprising:

at least one additional rib integrally formed in each one of the plurality of blades.

12. The rotor of claim 11 wherein each of the at least one additional ribs are stamped equidistantly and circumferentially from the central opening of each of the plurality of blades.

13. The rotor of claim 11 wherein each of the ribs are substantially identically shaped.

14. The rotor of claim 6 wherein the central opening of each of the plurality of blades is circular.

15. The rotor of claim 6 wherein each of the plurality of blades is metallic.

16. A device comprising:

a housing having exterior walls defining an interior;

a plurality of blades within the interior of the housing, each of the plurality of blades being smooth and planar and further having a central opening wherein the plurality of blades have an equal radius defining an outer periphery;

a shaft on which each of the plurality of blades is rotatably attached; and a first rib formed in each one of the plurality of blades, wherein the first rib creates a single, non-planar section in the planar layer in each one of the plurality of blades, and further wherein the first rib is equidistantly and circumferentially stamped in each of the plurality of blades such that the first rib formed in each one of the plurality of blades is aligned and parallel to any other first rib in each one of the plurality of blades.

17. The device of claim 16 further comprising:

an additional rib in each one of the plurality of blades wherein the additional rib is equidistantly and circumferentially stamped in each of the plurality of blades at a position intermediate the central opening and the outer periphery and distinct from a position of the first rib.

18. The device of claim 17 wherein the first rib and the additional rib are substantially identically shaped.

19. The device of claim 17 wherein the central opening is circular.

20. The device of claim 16 wherein the plurality of blades are metallic.

* * * * *